US005688195A

United States Patent [19]

Caso

[11] Patent Number: 5,688,195

[45] Date of Patent: Nov. 18, 1997

[54] TETHERED BALL AND SUPPORT STRUCTURE

[76] Inventor: Frank J. Caso, 11 Victor Ave., Eatontown, N.J. 07724

[21] Appl. No.: 670,243

[22] Filed: Jun. 17, 1996

Related U.S. Application Data

[63] Continuation-in-part of Ser. No. 474,676, Jun. 7, 1995, Pat. No. 5,542,679.

[51] Int. Cl.[6] ..... A63B 69/00

[52] U.S. Cl. ..... 473/429

[58] Field of Search ..... 273/413, 26 R, 273/26 E, 26 EA, 29 A, 58 C; 473/139, 145, 147, 175, 179, 423, 426, 427, 429, 430

[56] References Cited

U.S. PATENT DOCUMENTS

| | | | |
|---|---|---|---|
| D. 312,857 | 12/1990 | Montelongo | D21/210 |
| 1,959,574 | 5/1934 | Dunscombe | 273/298 |
| 2,772,882 | 12/1956 | Anson | 273/26 E |
| 3,216,723 | 11/1965 | Galezniak | 273/26 E |
| 4,204,682 | 5/1980 | Brown | 473/179 X |
| 4,786,053 | 11/1988 | Barnes, Jr. | 273/413 X |
| 4,793,612 | 12/1988 | Hammond | 273/26 E |
| 4,830,371 | 5/1989 | Lay | 273/26 E |
| 4,979,741 | 12/1990 | Butcher | 273/26 R |
| 5,071,122 | 12/1991 | Messina | 273/26 R |
| 5,135,219 | 8/1992 | McKeon et al. | 273/26 E |
| 5,226,646 | 7/1993 | Levatino | 273/26 R |
| 5,228,683 | 7/1993 | Beimel | 273/26 R |
| 5,230,506 | 7/1993 | Cipriano et al. | 273/26 R |
| 5,282,615 | 2/1994 | Green et al. | 273/26 E |
| 5,316,315 | 5/1994 | Roark, Jr. | 273/411 |
| 5,542,679 | 8/1996 | Caso | 273/413 |

*Primary Examiner*—William H. Grieb
*Attorney, Agent, or Firm*—Terrance L. Siemens

[57] ABSTRACT

An outdoor overhead arch forms a unique support for an appliance, such as a batting aid having a tethered ball. The arch is formed as two vertical posts, two slanted posts, and an upper horizontal post. The posts are connected to one another by elbow sections. The vertical posts are supported in ground mounted sleeves so that they may be manually lifted from the ground. The sleeves receive the vertical posts to a sufficient depth of penetration to provide rigid vertical support. Illustratively, should the tether of the batting aid become wound around the horizontal post to which it is attached, it is easily reached when the appliance is manually lowered. The appliance is readily removed from the sleeve for seasonal storage, and is readily reerected. The sleeve has a cap for safety and to prevent clogging when not in use. The cap may be formed to have a shallow recess, so that the sleeve serves as a golf hole. A variation shows the arch spanning a swimming pool.

11 Claims, 3 Drawing Sheets

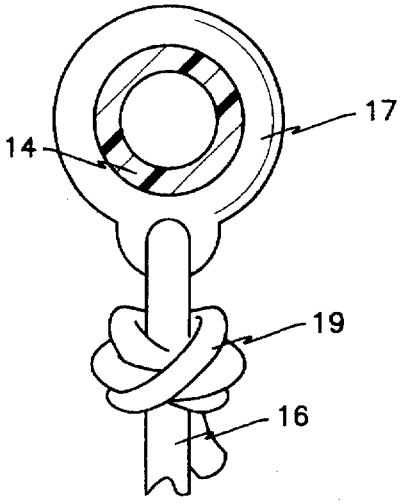
FIG. 2
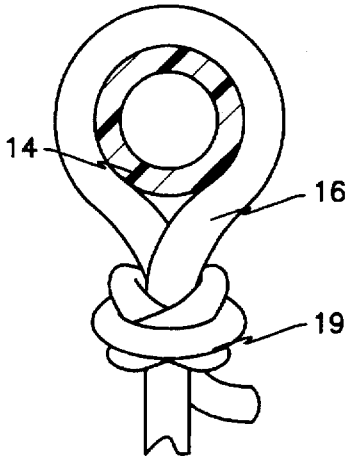
FIG. 2A
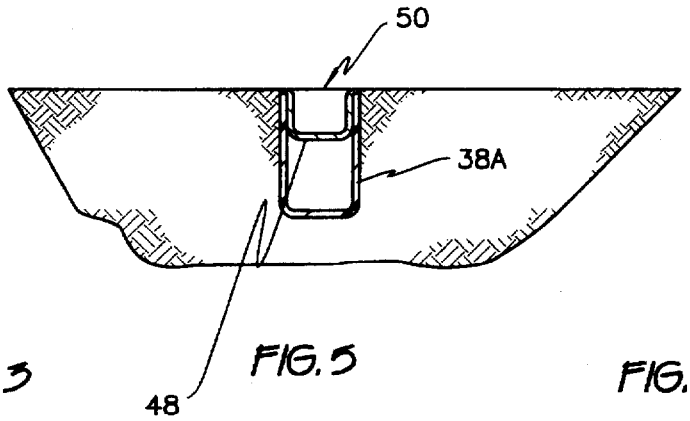
FIG. 5
FIG. 3
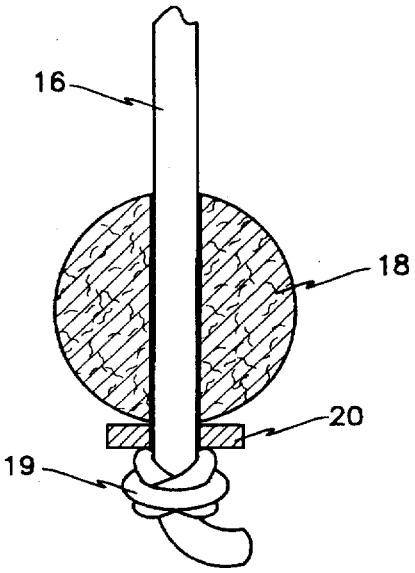
FIG. 3A
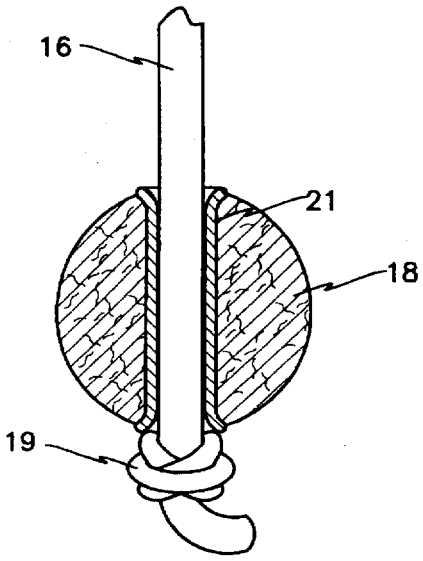

TETHERED BALL AND SUPPORT STRUCTURE

CROSS REFERENCE TO RELATED APPLICATION

This is a continuation-in-part of U.S. application Ser. No. 08/474,676 filed Jun. 7, 1995.

BACKGROUND OF THE INVENTION

1. Field of the Invention

The present invention relates to amusement devices, most advantageously to sports accessories such as batting aids, which are customarily supported on a member or leg anchored in the ground. The device has a unique overhead arch support structure with legs which are removably secured in the ground by sliding into a ground mounted sleeve. When the legs are lifted from the sleeves the support structure may be lowered towards the ground temporarily, for service, disassembly, or other purposes. More generally the overhead support structure may be used in fields other than athletic training and amusement. For example, it is contemplated that the overhead arch support could find applications in the building industry as a temporary support and in the automotive industry as a light-duty hoist support for parts and tools.

2. Description of the Prior Art

Sports accessories such as batting aids require considerable space, and are therefore frequently located outdoors. This location accommodates the relatively great span of tethered balls, which are frequently employed for softball batting practice, as well as for other games requiring tethered balls.

Batting practice has requirements which would render many simple tethered ball arrangements unsuitable. Notably, the batter must be able to stand near a tethered ball and be able to swing his or her bat through a generally horizontal arc without interference from supporting posts of the practice device. Accordingly, most batting aids have a tethered ball, or other target, spaced horizontally from a vertical support post.

U.S. Pat No. 5,135,219, issued to Tim O. McKeon et al. on Aug. 4, 1992, is exemplary. McKeon et al. provide a single vertical post which is embedded within the ground. By contrast, the present invention has two vertical posts each fitting into a ground sleeve to facilitate lifting the posts and lowering a horizontal tether support downwardly in order to free a ball which has become wound thereon.

In U.S. Pat. No. 4,793,612, issued to Robert G. Hammond on Dec. 27, 1988, a batting aid is set forth which also includes a single vertical support post.

A problem frequently encountered in tethered ball type batting aids is that the ball will occasionally cause the tether to wind around a structural post. McKeon et al. provide a second tether to prevent the ball from assuming a trajectory which would cause unintended winding at a point on the support posts which is out of easy reach. This second tether may possibly be objectionable, since it will inevitably be struck by the bat, and will entangle with the bat to a certain extent. This causes a radical departure from actual batting conditions. Hammond mounts his tether to a rotatable member secured to a horizontal support shaft. It would be possible for the tether to wind about this shaft in some circumstances, particularly when the plane of the struck ball is not vertical. The present invention avoids Hammond's complication of providing firstly, a rotatable member and secondly, a brace necessary for supporting the horizontal shaft.

In U.S. Pat. No. 4,979,741, issued to Gary J. Butcher on Dec. 25, 1990, U.S. Pat. No. 312,857, issued to Isaac Montelongo on Dec. 11, 1990, and U.S. Pat. No. 4,830,371, issued to William Lay on May 16, 1989, batting aids having a single vertical support post are shown. Butcher's batting aid is supported on a horizontal plate which rests on the ground. Lay's batting aid is supported on a home plate resting on and staked to the ground. Montelongo's vertical post has a stake driven into the ground. Both devices lack the two vertical posts and particularly ground sleeves of the present invention.

In U.S. Pat. No. 5,071,122, issued to Joseph A. Messina on Dec. 10, 1991, U.S. Pat. No. 5,226,646, issued to Samuel R. Levatino on Jul. 13, 1993, and U.S. Pat. No. 5,228,683, issued to Roger G. Beimel on Jul. 20, 1993, a central vertical support post is secured to at least one horizontal post to which the ball is attached. The vertical post is secured by several legs disposed in a horizontal plane. These devices lack the dual post arch support and ground sleeves of the present invention.

U.S. Pat. No. 5,230,506, issued to Ronald J. Cipriano et al. on Jul. 26, 1993, features a batting aid held by a second person. The subject device is not free standing, as is that of the present invention, and lacks an insertable joint and the two vertical support posts of the present invention.

U.S. Pat. No. 1,959,574, issued May 22, 1934 to Carroll Dunscombe, shows tennis net support posts set into ground support sleeves. However, the dual-post arch support of the instant invention is not taught or made obvious.

None of the above inventions and patents, taken either singly or in combination, is seen to anticipate or make obvious the instant invention as claimed.

SUMMARY OF THE INVENTION

The present invention provides a batting aid which spaces its structure at maximal distance from a batter, thereby minimizing distraction of the batter and improving concentration. This is accomplished by having two vertical posts, two upwardly and inwardly slanted posts, and an upper horizontal post spanning the slanted posts. The vertical posts are set well apart from one another, and the horizontal post is located considerably above the batter's head. The slanted posts serve to reduce the expanse of the upper horizontal support post, therefore significantly increasing the strength and rigidity.

The invention copes with potential winding or tangling of the tether about the horizontal post in a novel way. The vertical legs are each set into ground sleeves, so that the batting aid can be temporarily lowered. The tangled ball tether is then freed, and the batting aid is returned to its operative position.

The vertical posts each penetrate a rigid sleeve driven into the ground. The post is normally confined within the sleeve, below ground level, so that, normally, the structure resists displacement which occurs when the structure is pulled downwardly. Should a wound tether require access to be freed, the vertical posts are temporarily lifted out of their respective sleeves and the entire assembly may then be lowered to the ground for the necessary service. After the batting aid has been corrected, the vertical posts are again inserted into their ground support sleeves.

The sleeves may be left permanently in place in the ground. The sleeve's upper surfaces are flush with the ground surface so as not to interfere with other uses of the area when the batting aid is taken down. The sleeve avoids the necessity of driving a stake or like component into the ground each time the device is utilized. It also avoids the necessity of handling a potentially heavy or unwieldy horizontal support. The batting aid may be seasonally or periodically dismantled for storage, and reassembled at a later date. The sleeves may be capped for safety, and to prevent clogging with debris over time.

The ground sleeves are also suitable for supporting other outdoor appliances. Other sports devices, such as basketball hoops, tennis nets, and outdoor tables may employ the novel arrangement. The sleeve can further be employed as a hole for golf, a shallow cap being provided to prevent a golf ball from falling inaccessibly into the sleeve.

Accordingly, it is a principal object of the invention to provide an easily lowered overhead arch for the general purpose of suspending objects above the ground.

It is another object of the invention to utilize the overhead arch, in combination with a tethered ball, as a batting aid which spaces its structure at maximal distance from a batter.

It is another object of the invention to rigidly resist displacement of the structure of the batting aid during use, and to enable the structure to be readily taken down to free a tangled tether or store the device.

It is another object of the invention to provide a tether ball support structure which is durable and weather resistant yet easily disassembled for storage and shipping.

Still another object Of the invention is to provide a rigid overhead arch structure for supporting the upper end of a ball tether from an upper horizontal portion of the arch.

An additional object of the invention is to provide a loop portion at the upper end of the ball tether which permits free rotation of the tether about the upper horizontal portion of the arch.

An additional object of the invention is to provide means for preventing the loop portion of the tether from sliding off the upper horizontal portion of the arch.

It is also an object of the invention to provide permanent detachable ground mounting for a device supported in the ground.

It is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

FIG. 2 is a side elevational, cross sectional view taken along line 2—2 of FIG. 1 and showing one form of a tether loop.

FIG. 2A is a side elevational, cross sectional view taken along line 2—2 of FIG. 1 and showing another form of a tether loop.

FIG. 3 is a side elevational, cross sectional detail view taken along line 3—3 of FIG. 1 showing one means of fastening a ball to the lower end of the tether.

FIG. 3A is a side elevational, cross sectional detail view taken along line 3—3 of FIG. 1 showing another means of fastening a ball to the lower end of the tether.

FIG. 5 is a side elevational, cross sectional detail view of a sleeve, capped for use as a golf ball hole.

DETAILED DESCRIPTION OF THE PREFERRED EMBODIMENTS

Figure 1:
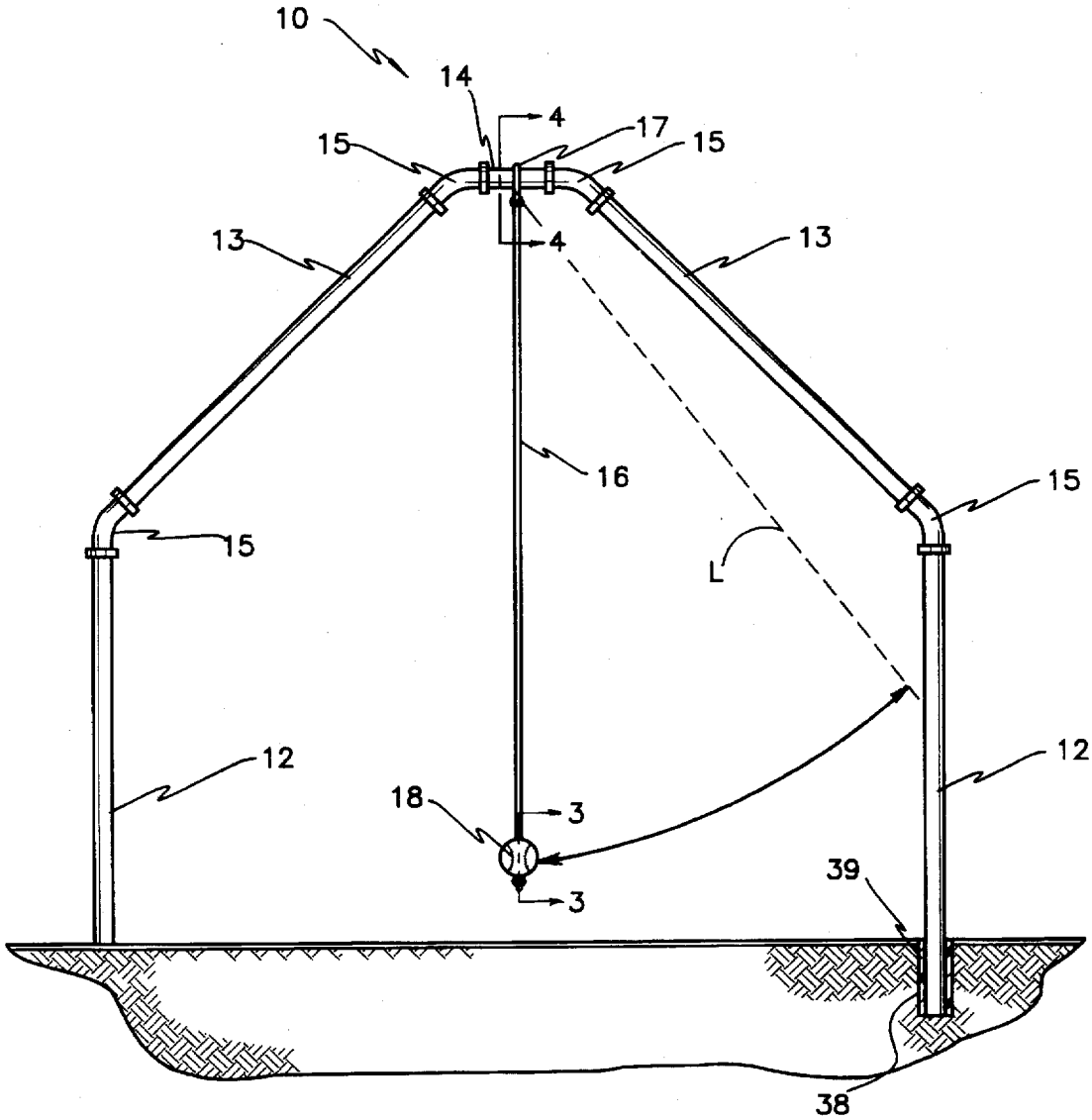
FIG. 1 is a side elevational view of the invention, as applied to a batting aid with a partially broken away section showing a ground mounted sleeve.

FIG. 1 of the drawings illustrates a representative application of the present invention as a batting aid 10 for batting practice. Batting aid 10 has two vertical posts 12, two angled posts 13, and a horizontal post 14 supported by and spanning angled posts 13. A tether 16 is attached at one end to a ring support 17 which loosely encircles horizontal post 14. The other end of tether 16 is attached to a ball 18 or like target object. Ball 18 is suspended from horizontal post 14 in easy reach of a person practicing batting.

The posts are preferably made of heavy duty PVC piping material as commonly used in residential plumbing. Elbow joints 15, connecting the tubing are standard PVC piping angled elbow joints. The angle and type of elbow joint chosen may vary. A 45 degree threaded elbow is shown for illustrative purposes. Threaded elbows 15 and complementary threaded posts 12, 13, and 14 allow for easy assembly and disassembly. The artisan will recognize that conventional unthreaded adhesive bonded joints would work as well if a more permanent installation were desired.

As clearly shown in FIG. 1 the pipes or posts 12, 13, and 14 and the elbow joints 15 are serially connected so as to form an overhead arch. The interposition of the angled posts in the arch makes it possible to form a high and wide arch without the use of any single length of pipe which is as high as, or as wide as, the overall arch. This means the unit may be broken down into individual components which are compact for shipping and storage yet are expansive and large when assembled. It will be obvious to the artisan that the use of threaded PVC components makes the arch suitable for outdoor use as well as light-weight and easy to assemble and disassemble.

Horizontal post 14 is sufficiently high so that any size person can comfortably stand under it while swinging a bat. Likewise, vertical posts 12 are set apart sufficiently so that a batter is not distracted by proximity of a post 12. It will also be seen from dashed line L that angled posts 13 afford considerable latitude for angled motion of the batted ball with respect to its intended direction of travel without entanglement with the sides of the arch.

FIG. 1 also illustrates, with a cutaway sectional view, another important aspect of the invention. Cylindrical PVC sleeve 38 is buried in the ground such that its upper end is at or slightly below ground level and its cylindrical axis is vertical. The inner diameter of sleeve 38 is slightly greater that the outer diameter of vertical post 12 so as to allow post 12 to be slid in and out of ground sleeve 38. It will be understood that a similar sleeve receives the vertical posts on each side of the arch. In use this allows a user of the above described arch to easily set up and remove the arch from predetermined positions where ground sleeves 38 have been installed. The internal upper end 39 of sleeve 38 may be threaded so as to receive a protective cap (not shown) when the arch is not in use. Note these threads are not for attaching vertical posts 12. The lower end of sleeve 38 may be open or closed as desired with the closed end version being shown as 38A in the variation of FIG. 5.

Post 12 is received in sleeve 38 which has been driven or otherwise set in the ground in preparation of assembly of the device. Sleeve 38 fits closely around post 12, but has sufficient play to enable manual insertion and withdrawal of post 12. Sleeves 38 hold posts 12 upright. This arrangement causes posts 12 to be vertically oriented whenever fully inserted into sleeves 38. From time to time, it may be necessary to gain access to the upper portion of the device. This is easily accomplished by lifting posts 12 clear of sleeves 38 and dropping the arch to the ground. It will be appreciated that sleeve 38 is sufficiently long so as to fully surround the lateral surfaces of lower vertical posts 12, at least enough to assure upright orientation when post 12 is fully inserted into sleeve 38.

Figure 4:
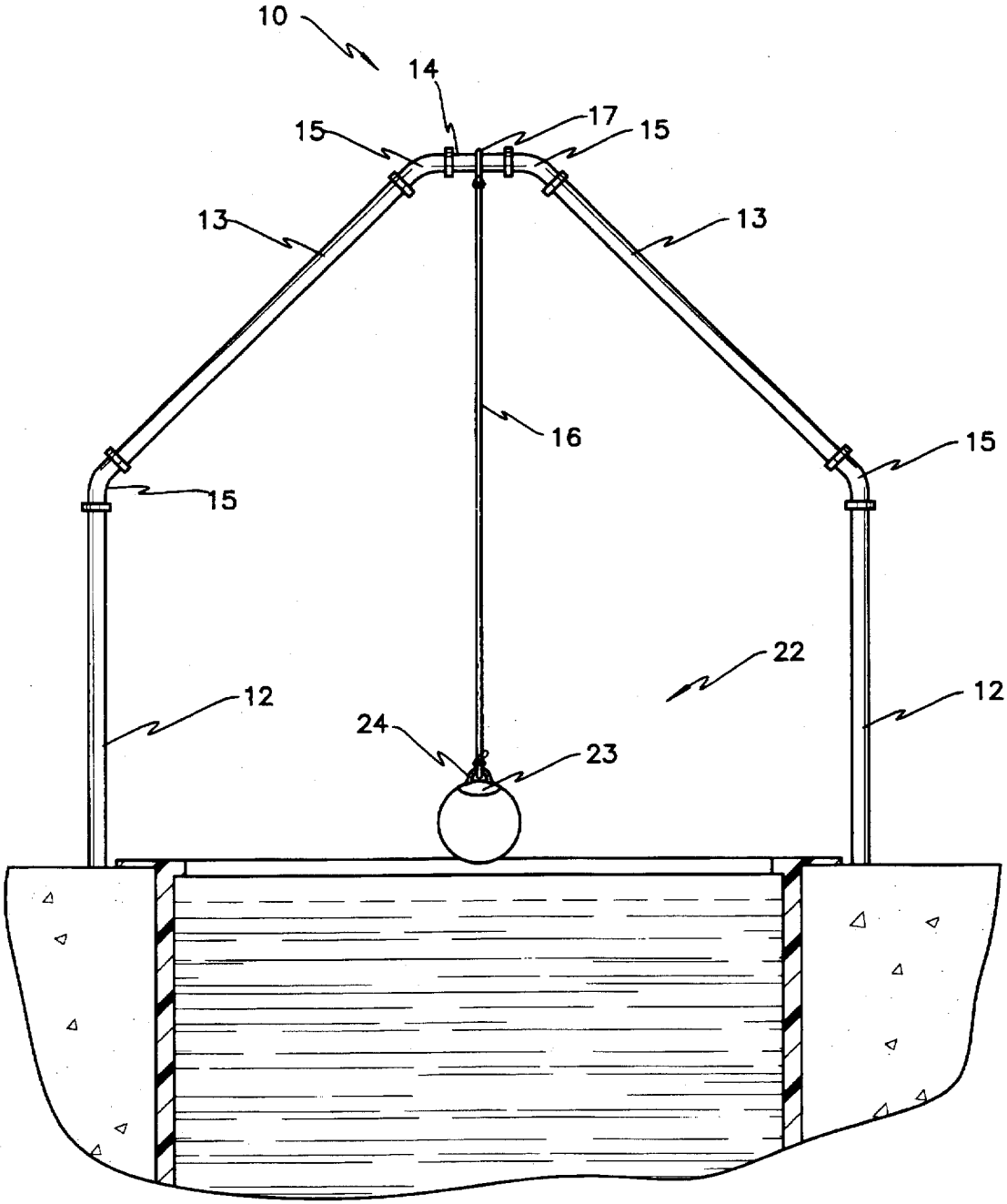
FIGS. 4 is an environmental side elevational view of the device shown spanning a swimming pool.

It must be emphasized that a batting aid is not the only possible application of the arch of this invention. Any outdoor device which is mounted to the ground and which finds recreational or utilitarian uses may also enjoy the practical benefits of my unique arch. One such alternative application is shown in FIG. 4, where a volley ball 18A is shown suspended over a swimming pool for use in water polo type games. The length of tether 16 in the embodiment of FIG. 4 may be increased so that the ball can float upon the water throughout the expanse of the swimming pool. The object of the device in this instance would be to merely keep the ball within the pool area and eliminate the need to crawl out of the pool to retrieve an errantly thrown ball.

The novel construction of ground sleeves 38 are also suitable for many applications. As shown in FIG. 5, when the arch is removed, sleeve 38A is sealed by a cooperating cap 48 for safety and to prevent clogging when not in use. While it is possible to make cap 48 flush with the ground, cap 48 is optionally formed to include an upwardly open concave recess 50. This enables sleeve 38A to be employed the capacity of a golf putting hole for receiving golf balls. Cap 48 elevates the floor of sleeve 38A, so that golf balls remain accessible to a golfer rather than fall inaccessibly to the bottom of sleeve 38A.

The upper portion of tether 16 is supported on horizontal post 14 with a ring member 17, best seen in FIG. 2. The tether is knotted as at 19 or otherwise fastened to the bottom of ring 17. Ring 17 fits loosely enough on post 14 to allow free rotation around the post, thus preventing inadvertent wrapping of the tether around the post. Clips, clamps, etc. (not shown) may be attached to horizontal post 14 on both sides of ring 17 to limit the sliding of ring 17 on post 14 to hold the tether in a central position. In the absence of such slide limits elbows 15 at each end of horizontal post 14 will serve as stops to prevent the ring from sliding onto angled posts 13 and out of operative position.

Another version of tether support is shown in FIG. 2A. This simplest of all versions involves merely looping tether 16 around post 14 and knotting it to itself as at 19. Knot 19 is of a variety which will not allow slipping and inadvertent tightening of the loop. As before free rotation is allowed and sideways sliding may be prevented by clips or clamps or ultimately prevented by contacting elbows 15.

The lower end of tether 16 may be attached to ball 18 by a variety of methods. Two such methods are shown in FIGS. 3 and 3A. In FIG. 3 a hole is drilled through ball 18 and the connection is made by passing tether 16 through the ball and supporting washer 20 and knotting at 19. In the variation of FIG. 3A a hole through the ball is lined with a sleeve 21. Sleeve 21 is expanded outwardly at each end to tightly maintain it within ball 18 and provide a support surface for knot 19 without the need for a supporting washer. Numerous other means of attaching a ball to a tether will occur to the artisan. For example, an inflated ball, such as the volleyball of FIG. 5, may be attached to the tether rope by an adhesive patch 23 which includes a tab 24 for tying to tether 16. The advantage of the adhesive patch is that the internal pressure of the ball need not be disturbed by attaching the tether.

It is to be understood that the present invention is not limited to the embodiments described above, but encompasses any and all embodiments within the scope of the following claims.

I claim:

1. An outdoor support means for a sporting appliance comprising;

two vertical sleeve means imbedded in the ground at positions horizontally separated from one another;

two vertical support posts having a lower end slidably receivable in said vertical sleeve means;

lower elbow joints fixed on an upper end of said vertical support posts;

two angled support posts attached at their lower ends to said lower elbow joints;

upper elbow joints fixed on an upper end of said angled support posts;

a horizontal support post fixed at each end to said upper elbow joints; wherein said vertical posts, said angled posts, and said horizontal post lie substantially in a common plane forming an overhead arch and said overhead arch is supported in a vertical position from the ground when said vertical posts are inserted into said sleeves and said overhead arch is lowerable to the ground when said vertical posts are lifted from said sleeves said outdoor support means, further comprising;

a suspended tether rotatably supported at its upper end on said horizontal post;

a ball attached to a lower end of said tether, wherein said arch, suspended tether, and ball comprise a batting aid whereby a user may practice batting said ball without retrieving the ball after each time it is batted.

2. The outdoor support means of claim 1, further comprising a ring means for rotatably supporting said tether on said horizontal post.

3. The outdoor support means of claim 2, wherein said ring means comprises;

a ring surrounding said horizontal post and including an aperture for tying off said tether; and a knot in said tether for preventing said tether from disengaging from said aperture in said ring.

4. The outdoor support means of claim 2, wherein said ring means comprises;

a loop in said tether surrounding said horizontal post; and a knot in said tether securing said loop around said horizontal post.

5. The outdoor support means of claim 2, wherein said upper elbows serve as stop means preventing said ring means from sliding off said horizontal post thereby preventing said suspended tether and ball from moving to an inoperative position too close to said vertical posts.

6. The outdoor support means of claim 2, further comprising ball attachment means for attaching said ball to said tether.

7. The outdoor support means of claim 6, wherein said ball is a solid ball, and said ball attachment means comprises;

a hole drilled through said ball, a support washer, and a knot tied in said tether after it has been passed through the hole in the ball and the washer.

8. The outdoor support means of claim 6, wherein said ball is a solid ball, and said ball attachment means comprises;

a hole drilled through said ball, a sleeve lining said hole in said ball, and a knot tied in said tether after it has been passed through said sleeve.

9. The outdoor support means of claim 6, wherein said ball is an inflated ball, and said ball attachment means comprises;

an adhesive patch adhered to an outer surface of said ball, and a tab on said patch suitable for tying to said tether.

10. The outdoor support means of claim 1, further comprising caps cooperating with and sealing said sleeve means.

11. The outdoor support means of claim 10, wherein said caps include means defining an upwardly open concave recess therein, whereby a golf ball is received and accessibly stored in said recess.

* * * * *